US006769216B2

(12) United States Patent
Lu

(10) Patent No.: US 6,769,216 B2
(45) Date of Patent: Aug. 3, 2004

(54) PROCESS OF WATERPROOFING CONSTRUCTION SURFACE AND SLIT OF CONSTRUCTION SURFACE

(76) Inventor: Chia-Lung Lu, Suite 5, 4F., No. 187, Dade 2nd Rd., Gangshan Jen, Kaohsiung (TW)

( * ) Notice: Subject to any disclaimer, the term of this patent is extended or adjusted under 35 U.S.C. 154(b) by 0 days.

(21) Appl. No.: 09/798,513

(22) Filed: Mar. 2, 2001

(65) Prior Publication Data

US 2001/0008060 A1 Jul. 19, 2001

Related U.S. Application Data

(63) Continuation-in-part of application No. 09/419,631, filed on Oct. 18, 1999, now abandoned.

(51) Int. Cl.[7] ..... E01C 5/18
(52) U.S. Cl. ..... 52/514; 52/514.5; 52/741.4
(58) Field of Search ..... 404/28, 17; 52/514.5, 52/514, 741.4

(56) References Cited

U.S. PATENT DOCUMENTS 1,958,871 A * 5/1934 Tucker ..... 72/127
2,294,247 A * 8/1942 Smith ..... 94/24
2,672,793 A * 3/1954 Rowe et al. ..... 94/3
2,798,822 A * 7/1957 Carter ..... 117/30
3,932,051 A * 1/1976 Cleary ..... 404/82
4,151,025 A * 4/1979 Jacobs ..... 156/71
4,392,335 A * 7/1983 Heiman ..... 52/309.17
4,556,338 A * 12/1985 Fahey ..... 404/28
4,684,288 A * 8/1987 Chapa ..... 404/35
5,660,498 A * 8/1997 Freeman ..... 404/17

* cited by examiner

*Primary Examiner*—Carl D. Friedman
*Assistant Examiner*—Basil Katcheves
(74) *Attorney, Agent, or Firm*—Bacon & Thomas

(57) ABSTRACT

A process for waterproofing a construction surface and slits of the construction surface comprises a first step in which the construction surface and the slits of the construction surface are dried by heating, so as to open up capillary pores of the construction surface and the slits of the construction surface. Thereafter, an appropriate amount of a synthetic asphalt is paved on the construction surface and the slits of the construction surface. The synthetic asphalt is then heated to permeate into the capillary pores of the construction surface and the slits of the construction surface.

1 Claim, 8 Drawing Sheets

PROCESS OF WATERPROOFING CONSTRUCTION SURFACE AND SLIT OF CONSTRUCTION SURFACE

CROSS REFERENCE OF RELATED APPLICATION

This is a Continuation-In-Part Application of a non-provisional application, application Ser. No. 09/419,631, filed Oct. 18, 1999 now abandoned.

FIELD OF THE PRESENT INVENTION

The present invention relates generally to the waterproofing of a construction surface, and more particularly to a process of waterproofing a construction surface under construction and a slit of the construction surface in use.

BACKGROUND OF THE PRESENT INVENTION

With reference to FIGS. 1 to FIG. 4, the conventional methods for constructing a horizontal surface 10 and a vertical surface 10' of a structure of cement concrete are described hereinafter.

As shown in FIG. 1, a horizontal reinforced screen support 12 is mounted on a horizontal molding plate 11. Thereafter, The horizontal molding plate 11 is filled with an appropriate thickness of a cement concrete 13, as shown in FIG. 2. As the cement concrete 13 is dry, the molding plate 11 is removed, thereby resulting in formation of the horizontal surface 10.

As shown in FIG. 3, a vertical reinforced screen support 14 is mounted on the horizontal surface 10 for building the vertical surface 10'. A vertical molding plate 11' is mounted on each of two sides of the vertical reinforced screen support 14. Thereafter, the cement concrete 13 is poured into the space located between the two vertical molding plates 11', as shown in FIG. 4. Upon completion of the drying and the hardening of the cement concrete 13, the two vertical molding plates 11' are removed, thereby resulting in formation of the vertical surface 10'.

As described above, the horizontal surface 10 and the vertical surface 10' are not built simultaneously. As a result, a slit 15 is apt to form at the juncture between the horizontal surface 10 and the vertical surface 10', as shown in FIG. 5. In light of the slit 15, the horizontal surface 10 and the vertical surface 10, are not waterproof. In addition, a surface crack 16 is often formed on the surface of the cement concrete after the cement concrete is dried and hardened. The formation of the surface crack 16 is often brought about by an incident in which a vibration takes place during the construction, or by an incident in which the cement is mixed with an inaccurate amount of water by the construction worker. The water may find its way into the structure via the surface crack 16. Moreover, a plurality of cavities 17 may be formed in the process of removing the molding plates 11 and 11', as shown in FIG. 5.

As shown in FIG. 6, the cement concrete 13 and the horizontal reinforced screen support 12 are different in nature such that they expand and contract differently in response to the changes in climatic elements, thereby resulting in formation of an interstice 18 between the horizontal reinforced screen support 12 and the cement concrete 13. It is likely that the horizontal surface 10 may contain water pipe, has pipe, ventilation pipe of septic tank, conductor of lightning arrester, etc., and that a gap 19 may be formed between the cement concrete 13 and these pipes P. The water may find its way into the structure via the gap 19.

As long as the slit 15, the surface crack 16, the interstice 18, and the gap 19 remain, the surface of the concrete is subject to weathering. The reinforced structures are also subject to corrosion. As a result, the service life span of the structure is seriously undermined.

With reference to FIGS. 7 to FIG. 9, the conventional method for waterproofing a cement concrete surface 20 is described hereinafter.

As shown in FIG. 7, the surface of the cement concrete surface 20 is paved with a mixture layer 21 which is formed of cement, sand and water. The surface of the mixture layer 21 is then paved with a waterproof material R, as shown in FIG. 8. The waterproof material R has a tensile strength, a tear strength, and an expansibility. The waterproof material may be a polymer material, a waterproof blanket, a waterproof board, an oiled felt, a polyvinyl chloride film, etc. In other words, the surface of the mixture layer 21 is paved with a waterproof layer 22.

As shown in FIG. 9, the surface of the waterproof layer 22 is paved with a surface layer 23 which is formed of a mortar and a plurality of bricks.

The waterproof layer 22 serves to prevent the water from finding its way into the structure. In light of the mixture layer 21 and the cement concrete surface 20 being different from each other in terms of expansion coefficient, the mixture layer 21 is apt to separate from the cement concrete surface 20, thereby resulting in formation of a gap 24 between the mixture layer 21 and the cement concrete surface 20, as shown in FIG. 10. In addition, the cement concrete surface 20 is subject to displacement in the course of expansion and contraction, thereby resulting in formation of a reflection crock 211 in the mixture layer 21. In addition, the waterproof material R of the waterproof layer 22 and the mixture layer 21 are made of different materials and are therefore different from each other in heat expansion coefficient. As a result, the waterproof material R of the waterproof layer 22 is apt to become separated from the mixture layer 21, thereby resulting in formation of a peeled-off area "D" at the wall corners. A slit 24 is thus formed between the cement concrete surface 20 and the mixture layer 21. Such a conventional method as described above is not cost-effective at best in view of the fact that the waterproof layer 22 must be replaced with new one every three or five years.

SUMMARY OF THE PRESENT INVENTION

It is the primary objective of the present invention to provide a process for waterproofing a construction surface and a slit of the construction surface. The process involves a first step in which the construction surface is dried by heating such that the capillary pores of the construction surface and the slit are opened up to facilitate the permeating of a synthetic asphalt into the capillary pores. Upon completion of the cooling process, the synthetic asphalt is securely implanted in the capillary pores of the construction surface and the slit of the construction surface. As a result, the construction surface is provided with a soft interface which is formed of the synthetic asphalt and is securely anchored to the construction surface. The soft interface is not apt to peel off from the construction surface and is effective in preventing the water from finding its way into the structure via the construction surface. In addition, the soft interface provides the construction surface with protection against weathering.

It is another objective of the present invention to provide a process for waterproofing a construction surface and a slit of the construction surface. The process involves the formation of a soft interface on the construction surface. The soft interface is formed of a synthetic asphalt and is intended to replace the mixture layer of the conventional process. The surface of the soft interface of the present invention may be paved with a synthetic turf, road bricks, insulation bricks, landscape pebbles, etc.

It is still another objective of the present invention to provide a process for waterproofing a construction surface and a slit of the construction surface. The process of the present invention involves the forming of a soft interface, on which a plurality of waterproof layers are paved.

DETAILED DESCRIPTIONS OF THE PRESENT INVENTION

A synthetic asphalt 30 of the process of the present invention is formed of a straight asphalt and a blown asphalt, which are prepared in an appropriate ratio. The molten synthetic asphalt 30 is capable of permeating into the capillary pores so as to seal off the slit or crack. In addition, the synthetic asphalt 30 of the present invention is capable of adhering the waterproof cloth and the construction material. At the normal temperature, the synthetic asphalt 30 is resilient, repellent to water, and resistant to corrosion.

Figure 1:
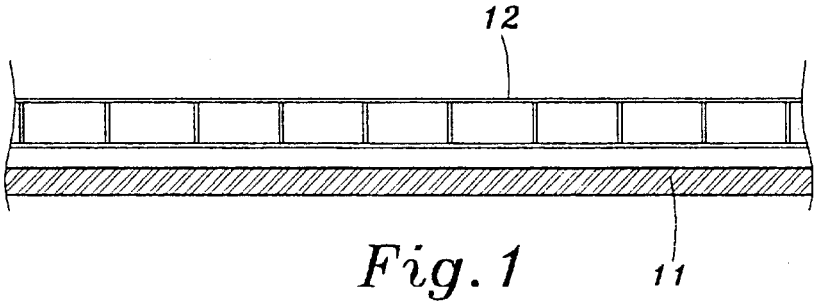
FIG. 1 shows a schematic view of the conventional process for building a horizontal construction surface.
Figure 2:
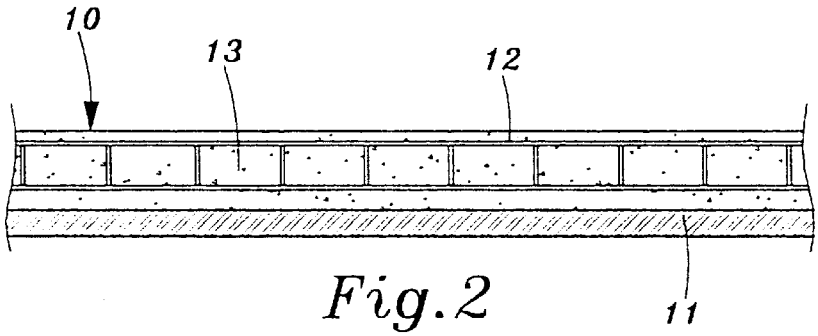
FIG. 2 shows another schematic view of the conventional process for forming the horizontal construction surface.
Figure 3:
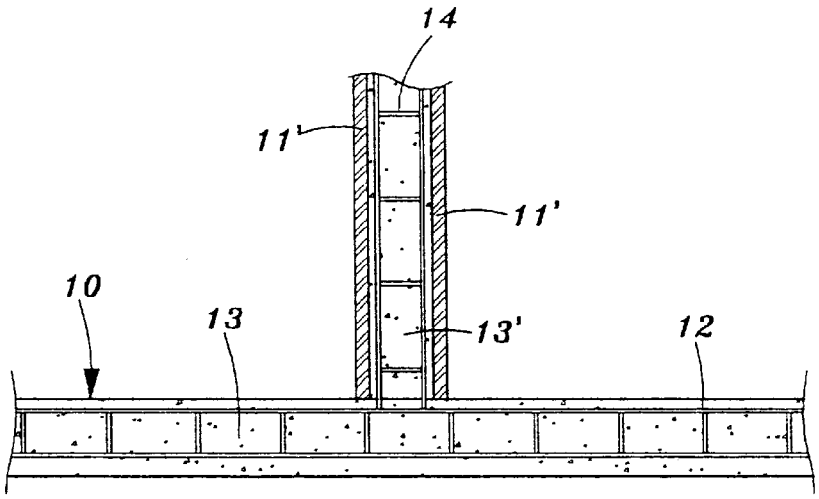
FIG. 3 shows a schematic view of the conventional process for building a vertical construction surface on the horizontal construction surface.
Figure 4:
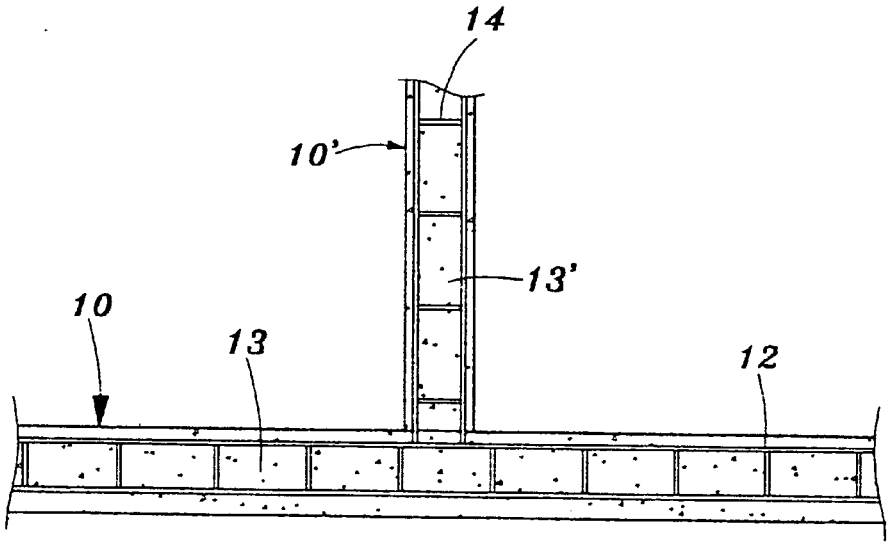
FIG. 4 shows another schematic view of the conventional process for building the vertical construction surface on the horizontal construction surface.
Figure 5:
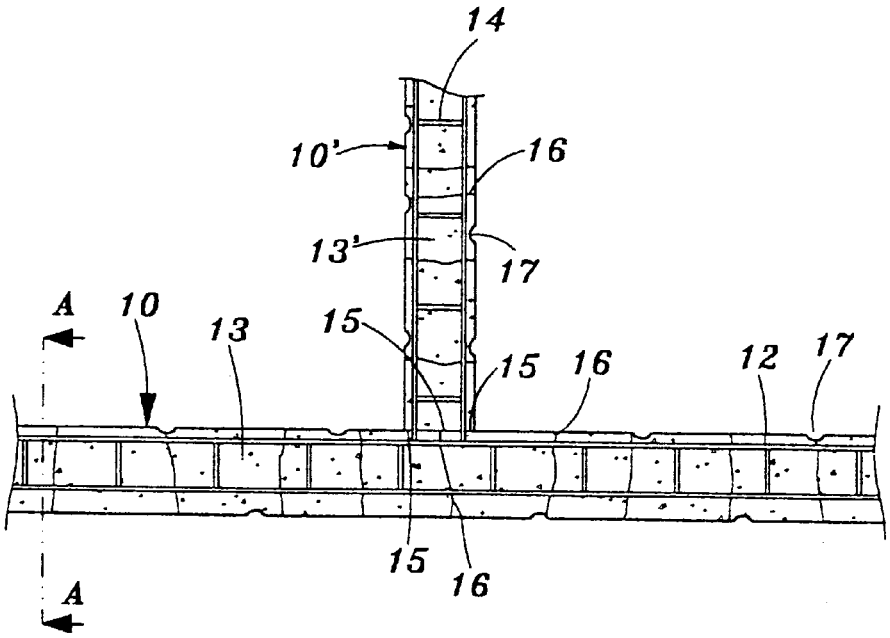
FIG. 5 shows a schematic view of the slit, the surface cracks and the cavities of the horizontal construction surface and the vertical construction surface of the conventional process.
Figure 6:
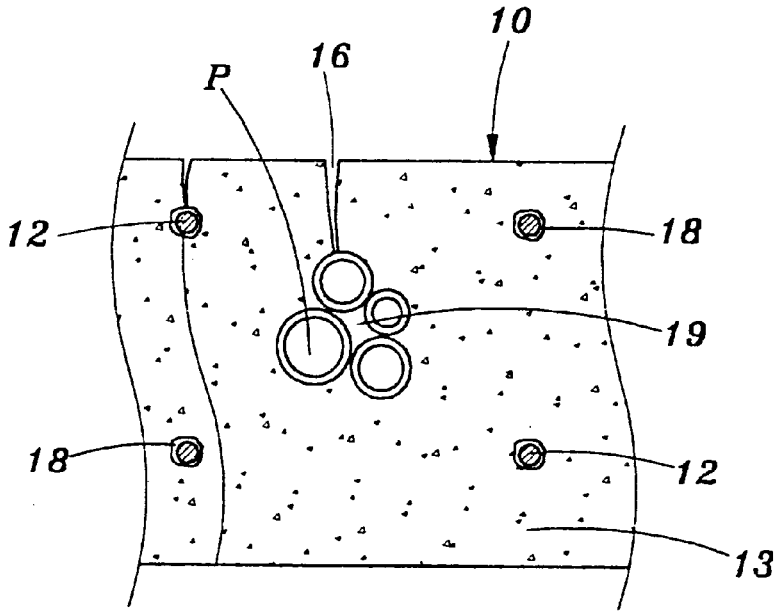
FIG. 6 shows an enlarged sectional view taken along a line A—A as shown in FIG. 5.
Figure 7:
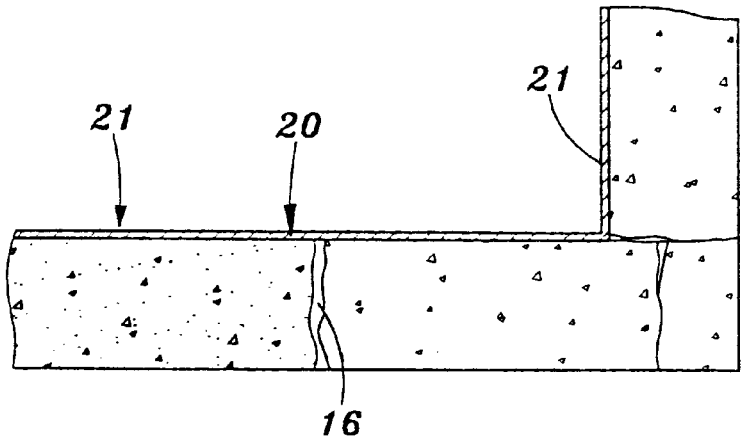
FIG. 7 shows a schematic view of the conventional process for waterproofing a cement concrete surface.
Figure 8:
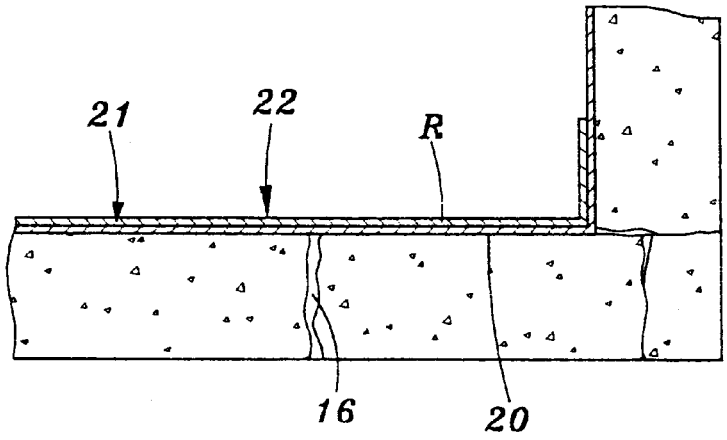
FIG. 8 shows another schematic view of the conventional process for waterproofing the cement concrete surface.
Figure 9:
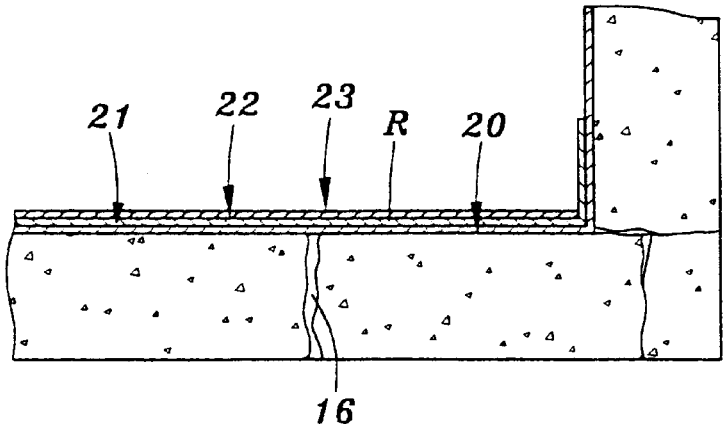
FIG. 9 shows still another schematic view of the conventional process for waterproofing the cement concrete surface.
Figure 10:
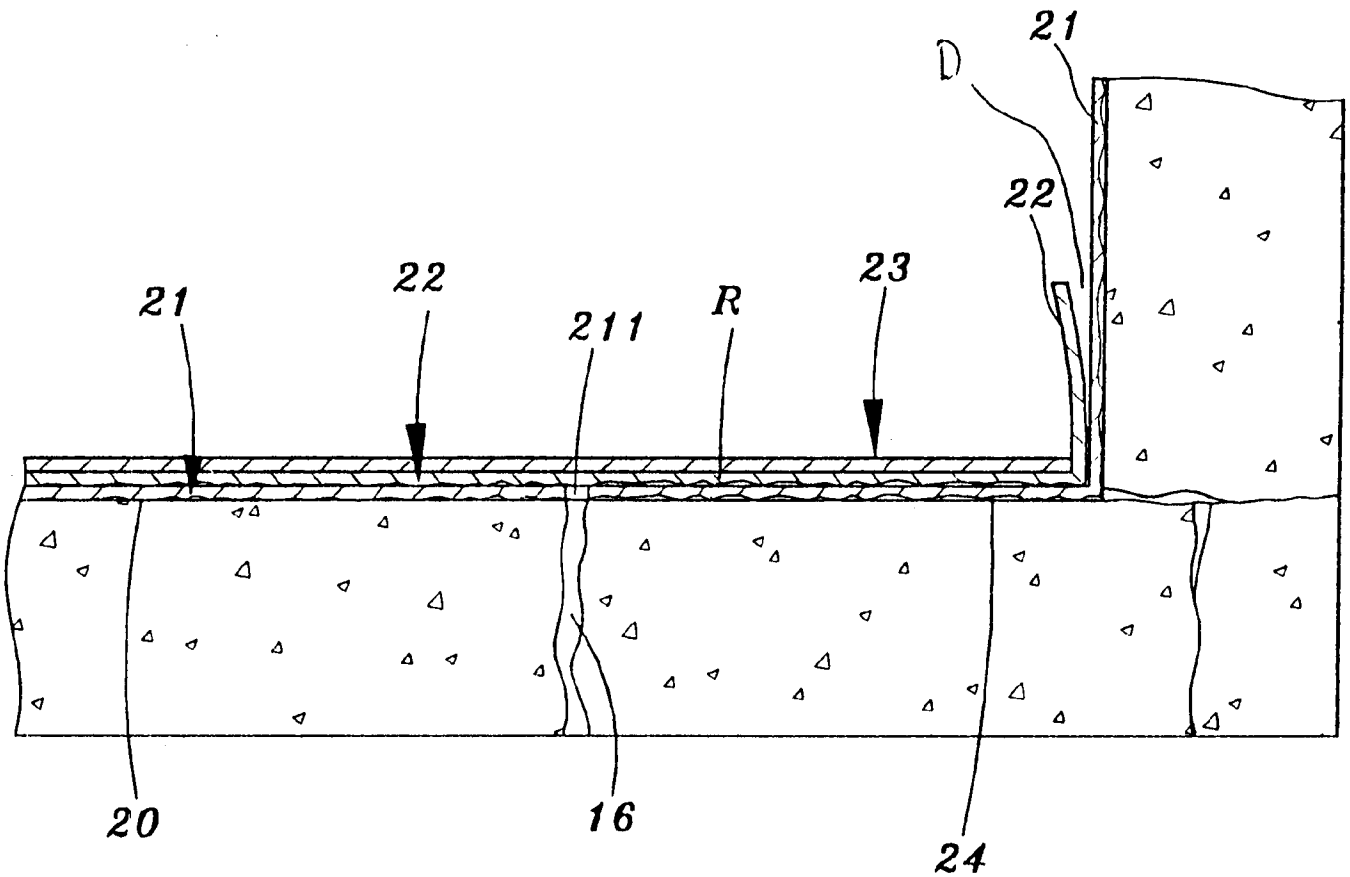
FIG. 10 shows an enlarged schematic view of the slits and the reflection crack of the conventional process.
Figure 11:
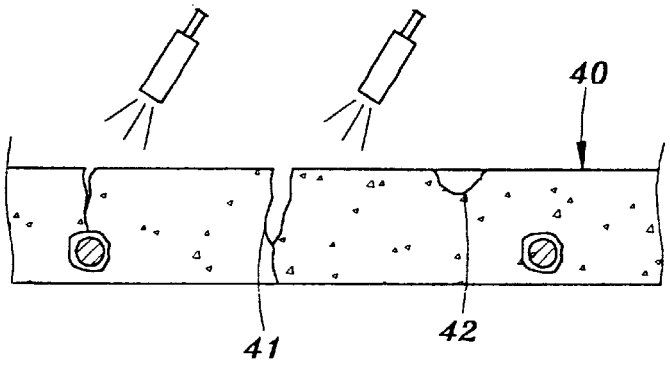
FIG. 11 shows a schematic view of the heating of the cracked surface by a process of the present invention.
Figure 12:
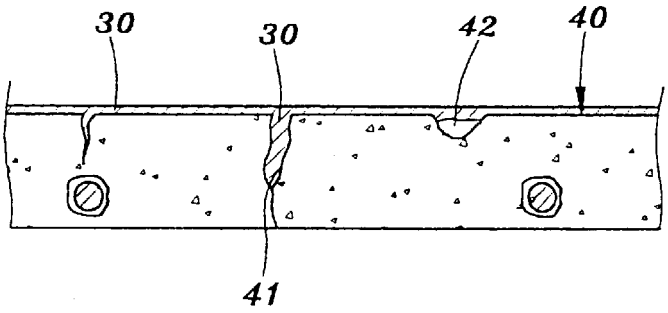
FIG. 12 shows a sectional schematic view of the slit which is filled with a synthetic asphalt of the process of the present invention.

As shown in FIG. 11, the process of the present invention involves a first step in which a construction surface 40 and a slit 41 are dried by heating, so as to open up the capillary holes of the construction surface 40 and the slits 41. A second step involves the coating of the dried construction surface 40 and the dried slits 41 with the synthetic asphalt 31. A third step involves the heating of the synthetic asphalt 30 which is spread on the surface 40 and the slits 41. The molten synthetic asphalt 30 is diffused into the capillary pores of the surface 40 and the slits 41, as illustrated in FIG. 12.

Figure 13:
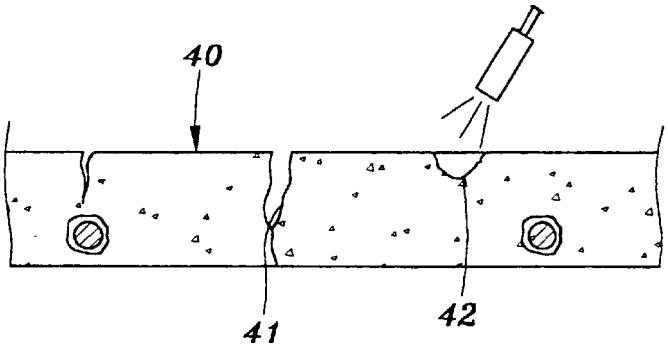
FIG. 13 shows a schematic view of the heating of the heating of a pitted surface by the process of the present invention.
Figure 14:
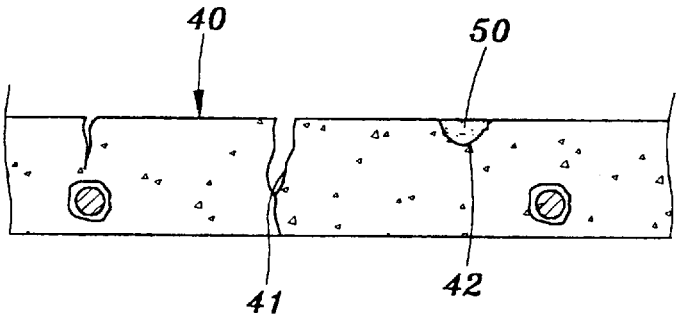
FIG. 14 shows a schematic view of the filling of the cavities with the synthetic asphalt of the process of the present invention.
Figure 15:
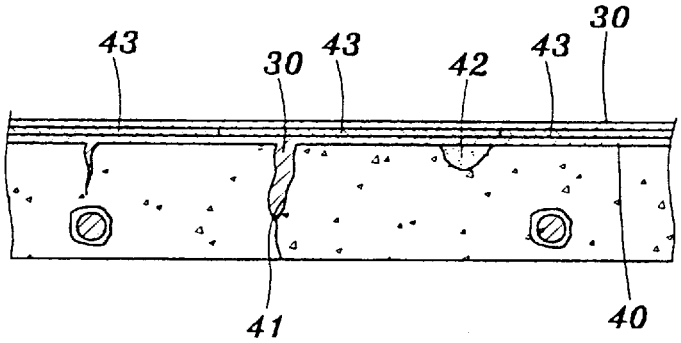
FIG. 15 shows a sectional schematic view of the process of the present invention providing a waterproof cloth on the synthetic asphalt and on the synthetic asphalt concrete.
Figure 16:
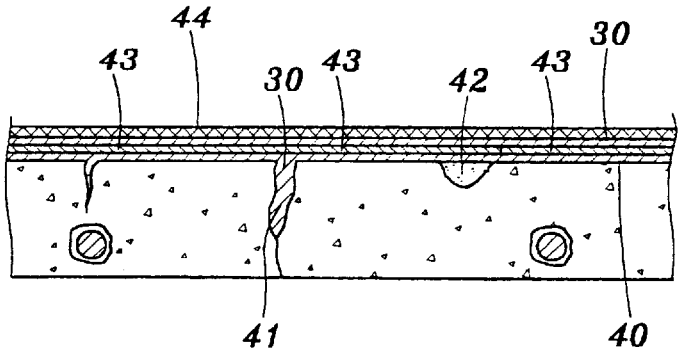
FIG. 16 shows a schematic view of a paving layer on the synthetic asphalt of the process of the present invention.

The slits 41 referred to in the above first step are second construction slits 411 and surface cracks 412. If the construction surface of the first step is provided with a coating layer such as bricks, foam concrete, paint protective layer, or insulation bricks, they should be removed. In addition, if the construction surface 40 is coated with another type of coating layer such as a conventional waterproof layer or polishing layer, they should be completely removed. If the construction surface has cavities 42, as shown in FIG. 13 and FIG. 14, prior to the first step, the cavities 42 must be heated Thereafter, the cavities 42 are filled with a synthetic asphalt concrete 50, which is formed of fine sand, stone powder, and the synthetic asphalt 30. Now referring to FIG. 15, after the third step, the synthetic asphalt 30 of the slits 41 and the synthetic asphalt concrete 50 of the cavities 42 are provided with a waterproof plastic cloth 43 attached thereto. Thereafter, the waterproof plastic cloth 42 is paved with the hot synthetic asphalt 30 so as to enhance the waterproof effect. As a result, the water is prevented from finding its way into the construction surface 40 via the slits 41 and the cavities 42. As shown in FIG. 16, the construction surface 40 is paved with the synthetic asphalt 30 forming a soft interface on which artificial turfs, road bricks, insulation bricks, or landscape pebbles 44, are matted without the use of any additional paving material.

In the first step of the process of the present invention, the slits 41 of the construction surface 40 is dried by heating. As a result, the capillary pores of the slits 41 of the construction surface 40 are opened up to facilitate the permeating of the molten synthetic asphalt 30 into the capillary pores of the construction surface 40 and the slits 41. Upon completion of the cooling of the synthetic asphalt 30, the construction surface 40 and the slits 41 are provided with a soft interface which cannot be peeled off in the wake of the expansion-contraction effect. The synthetic asphalt 30 is securely implanted in the slits 41, In light of the protective effect of the soft interface, the service life span of the construction surface 40 if effectively prolonged. In addition, the construction surface 40 is not subject to weathering.

Figure 17:
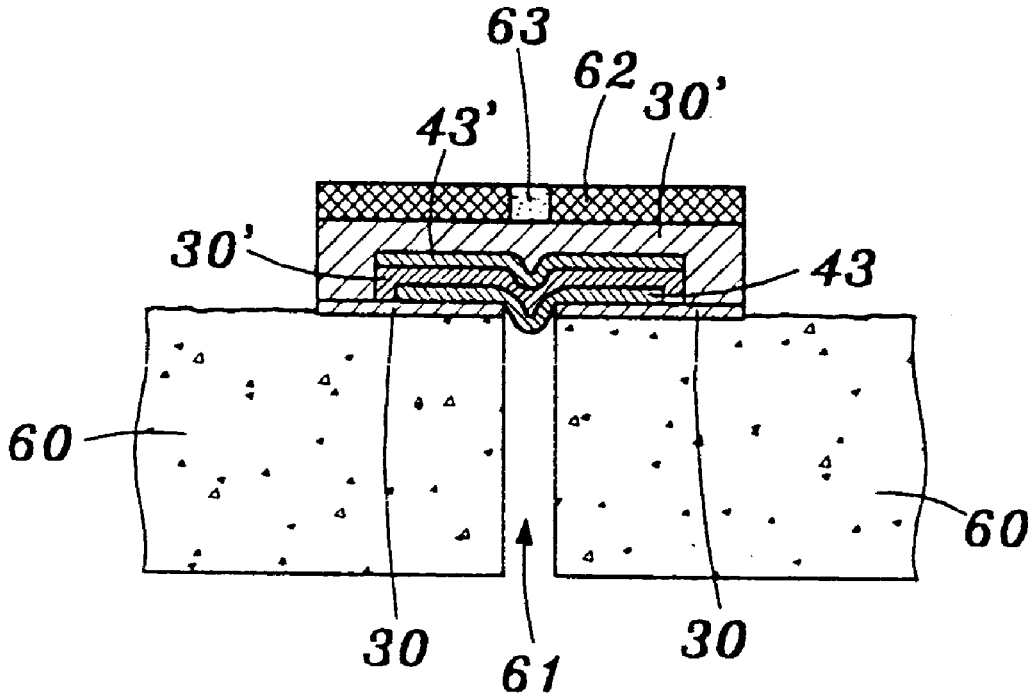
FIG. 17 shows a sectional schematic view of the waterproofing of an expansion slit of the top floor surface by the process of the present invention.

As shown in FIG. 17, the process of the present invention is employed to waterproof an expansion slit 61 located between two cement concrete surfaces 60, The process includes a first step in which the cement concrete surfaces 60 located at two sides of the expansion lit 61 are ground and smoothed. Thereafter, the smooth surfaces 60 are paved with an appropriated amount of the synthetic asphalt 30, which is then heated to cause the synthetic asphalt 30 to permeate into the capillary pores of the smooth surfaces 60. A waterproof plastic cloth 43 is subsequently attached to the synthetic asphalt 30 such that an expansion space is provided. The waterproof plastic cloth 43 is paved with a hot molten synthetic asphalt 30' such that the waterproof plastic cloth 43 is securely held between the two synthetic asphalts 30 and 30' Another waterproof plastic cloth 43' is then attached to the surface of the second synthetic asphalt 30'. This second waterproof plastic cloth 43' is paved with another second synthetic asphalt 30' and is therefore held securely between the two synthetic asphalts 30' such that an expansion space is provided. The expansion slit 61 is provided in two sides with a plurality of waterproof bricks 62 attached thereto for enhancing the waterproof effect and for pressing the first waterproof cloth 43 and the second waterproof cloth 43'. The interstices of the waterproof bricks 62 are filled with sand and fine pebbles to complete the process.

As described above, the expansion slit 61 is provided in two sides there of with the synthetic asphalt 30 on which the first waterproof plastic cloth 30 or the second waterproof plastic cloth 30' is held. As a result, the expansion slit 61 is securely waterproof such that water is prevented from finding its way into the space between the two cement concrete surface 60 via the expansion slit 61.

What is claimed is:

1. A process of waterproofing an expansion slit located between two cement concrete surfaces, comprising the steps of:

(a) grounding and smoothing said two cement concrete surfaces located at two sides of said expansion slit;

(b) paving a first layer of synthetic asphalt on said cement concrete surfaces;

(c) heating said first layer of synthetic asphalt to a molten state that permeates into capillary pores of said cement concrete surfaces;

(d) attaching a first layer of waterproof plastic cloth on said first layer of synthetic asphalt such that a first expansion space is provided;

(e) paving a second layer of hot molten synthetic asphalt on said first layer of waterproof plastic cloth so as to securely hold said first layer of waterproof plastic cloth between said first and second layers of synthetic asphalt;

(f) attaching a second layer of waterproof plastic cloth on said second layer of synthetic asphalt;

(g) paving a third layer of synthetic asphalt on said second layer of waterproof plastic cloth so as to hold said second layer of waterproof plastic cloth securely between said second and third layers synthetic asphalt such that a second expansion space is provided, wherein said synthetic asphalt of said first, second and third layers of synthetic asphalt is a mixture of a straight asphalt and a blown asphalt adapted for adhering waterproof cloth and construction material and being resilient and repellent to water and resistant to corrosion;

(h) providing in two sides of an expansion slit with a plurality of waterproof bricks attached thereto for enhancing a waterproof effect and for pressing said first and second layers of waterproof plastic cloth; and (i) filling interstices of said waterproof bricks with sand and fine pebbles.

* * * * *